US006908331B2

(12) United States Patent
Brown

(10) Patent No.: US 6,908,331 B2
(45) Date of Patent: Jun. 21, 2005

(54) INSULATION STRIPPING CONNECTOR FOR INSULATED WIRES

(76) Inventor: Donald C. Brown, 49 Royal Rd., Freehold, NJ (US) 07728

( * ) Notice: Subject to any disclaimer, the term of this patent is extended or adjusted under 35 U.S.C. 154(b) by 0 days.

(21) Appl. No.: 10/669,182

(22) Filed: Sep. 23, 2003

(65) Prior Publication Data

US 2004/0077208 A1 Apr. 22, 2004

Related U.S. Application Data

(60) Provisional application No. 60/414,438, filed on Sep. 27, 2002.

(51) Int. Cl.[7] ..... H01R 4/24
(52) U.S. Cl. ..... 439/395
(58) Field of Search ..... 439/395, 404, 439/396, 398, 389, 417

(56) References Cited

U.S. PATENT DOCUMENTS 3,932,018 A * 1/1976 Parsons et al. ..... 439/422
4,012,102 A 3/1977 Cherney et al.
4,106,837 A 8/1978 Paluch
4,553,808 A * 11/1985 Weidler et al. ..... 439/391
4,749,365 A 6/1988 Magnifico et al.
5,588,869 A * 12/1996 Jensen et al. ..... 439/417
5,827,087 A * 10/1998 Yamasaki ..... 439/395

FOREIGN PATENT DOCUMENTS

DE 3116731 A1 11/1982
GB 2019118 A 10/1979

* cited by examiner

*Primary Examiner*—Gary Paumen
*Assistant Examiner*—Felix O. Figueroa
(74) *Attorney, Agent, or Firm*—McCarter & English, LLP

(57) ABSTRACT

An insulation stripping connector for providing an electrical connection to a wire having a pair of outer legs and a pair of inner legs, with the inner legs forming a wire slot therebetween. The outer legs and inner legs are sufficiently flexible in order to enable the wire slot to open in response to the insertion of a wire into the wire slot. Each of the outer legs is notched, thereby increasing their flexibility and enabling the wire slot to open wider in order to accommodate a large range of wire sizes.

48 Claims, 7 Drawing Sheets

INSULATION STRIPPING CONNECTOR FOR INSULATED WIRES

CROSS-REFERENCE TO RELATED APPLICATION

This application is a §111 (a) application relating to commonly owned co-pending U.S. Provisional Application Ser. No. 60/414,438, entitled "Insulation Stripping Connector for Insulated Wires," filed Sep. 27, 2002.

FIELD OF THE INVENTION

The present invention relates to insulation stripping connectors and, more particularly, to insulation stripping connectors for use in the electrical connection of wiring.

BACKGROUND OF THE INVENTION

Insulation stripping connectors (sometimes referred to in the art as "insulation displacement connectors," "IDC's" or "terminals") are widely used in industry, particularly within the telecommunication, automotive solenoid and electrical motor fields. Insulation stripping connectors offer reliable, gas-tight connections, and their ease and speed of installation eliminate the need for wire stripping, crimping, or soldering techniques. However, the problem with existing insulation stripping connectors is that they accommodate only a small range of wire sizes. For instance, many existing connectors feature rigid beams or legs that engage wire when such connectors are inserted into their associated housings or bobbins. Since the beams or legs offer very little, if any, flexibility, the connectors can only accommodate two to three wire sizes. Consequently, a user must purchase, stock, and utilize many different insulation stripping connectors for use with a wide range of wire sizes.

U.S. Pat. No. 4,749,365 to Magnifico (the "Magnifico '365 Patent") attempted to address the aforementioned shortcoming of prior insulation stripping connectors. The Magnifico '365 Patent discloses an insulation displacement terminal that includes flexible inner beams and stiff outer beams that allow for the accommodation of a range of wire sizes. However, the range of wire sizes that can be used in conjunction with the terminal disclosed in the Magnifico '365 Patent is limited by the elastic limit of the material used to manufacture the terminal, particularly the elastic limit of the terminal's inner beams. For instance, a large size wire that engages the terminal may force apart the inner beams to a point that exceeds their elastic limit, resulting in the inner beams losing their elasticity. While exceeding the elastic limit of the inner beams may make an acceptable initial connection with the wire, the failure of this connection can occur due to various environmental conditions, such as ordinary vibrations exerted upon the terminal, as well as diameter changes of the wire, which are caused by reduced or elevated temperatures. Since the inner beams have lost their elasticity, a gas-tight connection between the terminal and the wire is lost. As a result, molecules of oxygen or other gases can enter the interface between the terminal and the wire, thereby causing a buildup of corrosion on the terminal and/or the wire. Consequently, the loss of the gas-tight connection between the terminal and the wire causes intermittent or open circuits during use. Thus, the range of wires that can be reliably used with the terminal disclosed in the Magnifico '365 Patent is severely limited.

In addition, the terminal covered by the Magnifico '365 Patent discloses small slits and coined areas located at common expanses (where the inner and outer beams are joined). The slits and the coined areas partially divide the inner and outer beams. The Magnifico '365 Patent discloses that the function of the slits and the coined areas is to create a force that pushes the inner beams toward each other when the terminal engages a wire. The Magnifico '365 Patent further discloses that this configuration allows for the manufacture of a narrow wire slot, thereby increasing the range of wire sizes that can be used in conjunction with the terminal, as well as improving the connecting features of the terminal. However, the problem with this configuration is that the sizes of the slits and the coined areas are very difficult to manufacture within the terminal's specifications, due to variations in the hardness of the material used to manufacture the terminal, as well as the sharpness of the tools used to create the slits and the coined areas. Since the size of the wire slot depends upon the sizes of the slits and the coined areas, any deviation in the sizes of slits and/or the coined areas would affect the size of the wire slot. For instance, if a slit and/or a coined area is manufactured too small, then the width of the wire slot will be too large. As a result, the inner beams would not maintain a sufficient connection with the wire. On the other hand, if a slit and/or a coined area are manufactured too large, then the width of the wire slot will either be too narrow or the wire slot will be closed up (i.e., the inner beams would be preloaded and, therefore, converge with one another). As a result, a wire that is inserted in the wire slot may be severed when it is engaged with the terminal. Moreover, if the slit contains a gap, then the elastic characteristics of the inner beams would be eliminated. Also, if the slit is manufactured too long, then the inner beams will almost be severed from the outer beams, thereby eliminating the elastic characteristics of the inner beams. As a result of any of the foregoing scenarios, the terminal would not provide a reliable electrical or gas-tight connection with the wire.

Accordingly, there is a need for an insulation stripping connector that can accommodate a large range of wire sizes, while providing a reliable gas-tight connection between the connector and the wire and, at the same time, maintaining the elastic integrity of the inner legs of the connector.

SUMMARY OF THE INVENTION

The problems and disadvantages associated with the prior art are overcome by the present invention, which includes an insulation stripping connector for providing an electrical connection to a wire. The connector has a body, a pair of outer legs, each of which is attached to and extends away from the body, and a pair of inner legs, each of which is joined to a corresponding one of the pair of outer legs and extends towards the body, terminating at a free end that is spaced from the body and from the corresponding outer leg. The inner legs form a wire slot therebetween for the introduction of a wire therein. More particularly, the configuration of the connector allows for the inclusion of a narrow wire slot that accommodates a large range of wire sizes, while overcoming the shortcomings of the prior art. For instance, the inner legs and the outer legs are sufficiently flexible in order to enable the wire slot to open in response to the insertion of a wire into the wire slot. In addition, each of the outer legs is notched in the vicinity of where the outer leg is attached to the body so as to increase the flexibility of the outer legs, thereby enabling the wire slot to open wider in order to accommodate a large range of wire sizes.

The forces created by the connector that strip the insulation from a wire differ from the forces created by the connector that are required to maintain constant pressure on the wire. As a result, a gas tight connection between the connector and the wire is ensured, regardless of ordinary vibrations that cause the wire to move and/or temperature variations that cause the wire to expand and contract. The connector further includes a barrier that inhibits a wire from passing beyond the free ends of the inner legs, thereby preventing the connector from losing connection with the wire to which it is being engaged.

Further features and advantages of the invention will appear more clearly on a reading of the detailed description of the exemplary embodiments of the invention, which are given below by way of example only with reference to the accompanying drawings.

BRIEF DESCRIPTION OF THE DRAWINGS

For a better understanding of the present invention, reference is made to the following detailed description of the exemplary embodiments considered in conjunction with the accompanying drawings, in which.

DETAILED DESCRIPTION OF THE DRAWINGS

Figure 2:
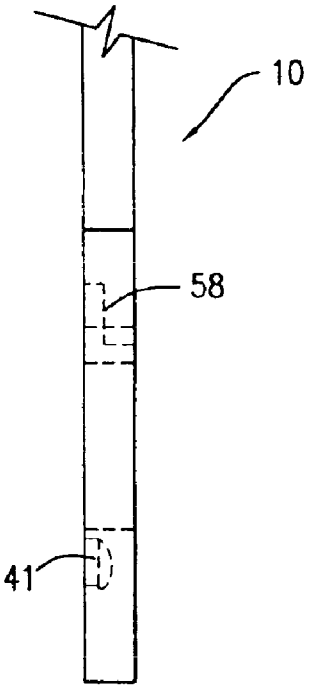
FIG. 2 is a side elevational view of the insulation stripping connector of FIG. 1.
Figure 1:
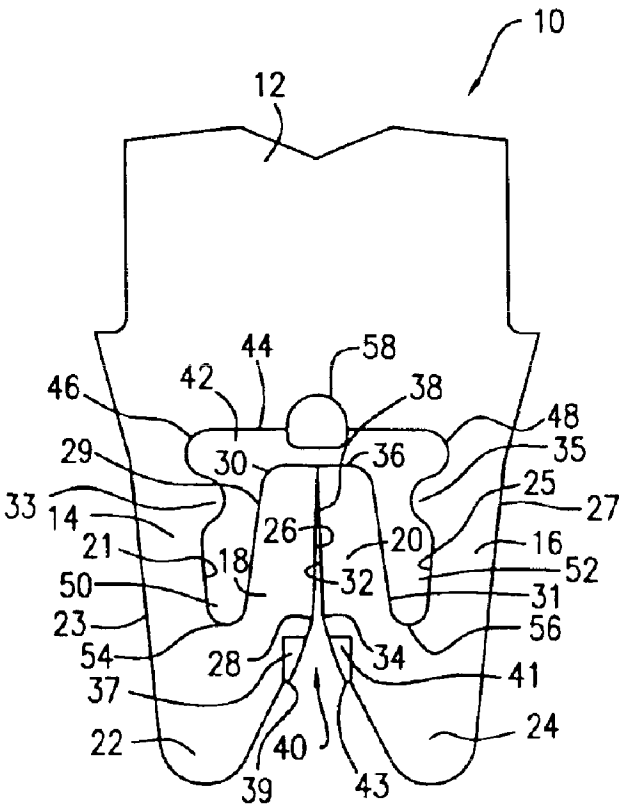
FIG. 1 is a front elevational view of an insulation stripping connector constructed in accordance with one exemplary embodiment of the present invention.

Referring to FIGS. 1 and 2, an insulation stripping connector 10 includes a body 12, a pair of cantilevered outer legs 14, 16 that extend from the body 12 in a longitudinal direction, and a pair of inner legs 18, 20 that extend in an opposite longitudinal direction. The outer leg 14 is joined to the inner leg 18 by a common span 22, thereby forming a V-shape. Similarly, the outer leg 16 is joined to the inner leg 20 by a common span 24, thereby forming a V-shape. The outer legs 14, 16, the inner legs 18, 20 and the common spans 22, 24 cooperate to form a W-shape. The outer leg 14 has an inboard side 21 and an outboard side 23 opposite the inboard side 21. Similarly, the outer leg 16 has an inboard side 25 and an outboard side 27 opposite the inboard side 25. The inner leg 18 includes an inboard side 26 that extends from a transition point 28 to a free end 30 of the inner leg 18, and an outboard side 29 opposite the inboard side 26. Similarly, the inner leg 20 includes an inboard side 32 that extends from a transition point 34 to a free end 36 of the inner leg 20, and an outboard side 31 opposite the inboard side 32. The inboard side 21 of the outer leg 14 has a semicircular-shaped stop 33 that extends toward the outboard side 29 of the inner leg 18. Similarly, the inboard side 25 of the outer leg 16 has a semicircular-shaped stop 35 that extends toward the outboard side 31 of the inner leg 20. The function of the stops 33, 35 shall be described hereinafter. The inboard sides 26, 32 of the inner legs 18, 20 form a narrow wire slot 38 whose function will be described hereinafter. The inner legs 18, 20 converge at their respective free ends 30, 36. It is noted that the free ends 30, 36 of the inner legs 18, 20 are resiliently biased, but they can be forced apart in a manner that will be described hereinafter. The transition points 28, 34 are located where the inboard sides 26, 32 of the inner legs 18, 20 are joined to the common spans 22, 24. An entry gap 40, whose function will be described hereinafter, is located between the common spans 22, 24.

The common span 22 contains a coined area 37 located below the transition point 28 and proximate to the entry gap 40, which forms a triangular shaped cutter 39 that extends into the entry gap 40. Similarly, the common span 24 contains a coined area 41 located below the transition point 34 and proximate to the entry gap 40, which forms a triangular shaped cutter 43 that extends into the entry gap 40. The function of the cutters 39, 43 shall be described hereinafter.

Still referring to FIGS. 1 and 2, the connector 10 further includes a cutout 42 that separates the inner leg 18 from the body 12 and from the outer leg 14, while also separating the inner leg 20 from the body 12 and from the outer leg 16. More particularly, the cutout 42 includes a lateral branch 44 that separates the free end 30 of the inner leg 18 and the free end 36 of the inner leg 20 from the body 12. The lateral branch 44 terminates at opposed ends in a pair of semicircular-shaped notches 46, 48 whose function will be described hereinafter. The notch 46 is formed within the inboard side 21 of the outer leg 14 and proximate to the stop 33, while the notch 48 is formed within the inboard side 25 of the outer leg 16 and proximate to the stop 35.

The cutout 42 further includes a pair of longitudinal branches 50, 52. The longitudinal branch 50 extends from the lateral branch 44 and separates the inboard side 21 of the outer leg 14 from the outboard side 29 of the inner leg 18. Similarly, the longitudinal branch 52 extends from the lateral branch 44 and separates the inboard side 25 of the outer leg 16 from the outboard side 31 of the inner leg 20. The longitudinal branch 50 terminates at an end remote from the lateral branch 44 in the form of a semicircular-shaped notch 54 whose function will be described hereinafter. Similarly, the longitudinal branch 52 terminates at an end remote from the lateral branch 44 in the form of a semicircular-shaped notch 56 whose function will described hereinafter. A semicircular-shaped barrier 58, which can have other shapes and sizes, is coined from the body 12 and extends into the lateral branch 44 directly across from the free ends 30, 36 of the inner legs 18, 20. The barrier 58 performs a function that shall be described hereinafter.

It is noteworthy that the body 12 can consist of many different shapes and sizes, depending upon the specific application of the connector 10. While the notches 46, 48 and the notches 54, 56 are preferably semicircular in shape, it should be noted that they can consist of other shapes and sizes. Also, the stops 33, 35 are preferably semicircular in shape, but they can consist of other shapes and sizes. The cutters 39, 43 are preferably triangular in shape, but they can consist of other shapes and sizes. In addition, the connector 10 is preferably manufactured from copper alloy. However, the connector 10 may be made from other materials.

Figure 3C:
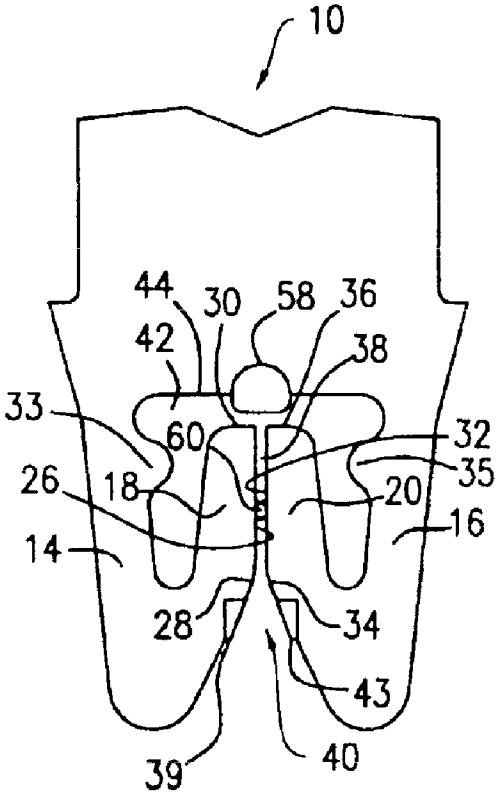
FIGS. 3*a–c* are sequential front elevational views showing the insulation stripping connector of FIGS. 1 and 2 as it is being connected to a small size wire.
Figure 3B:
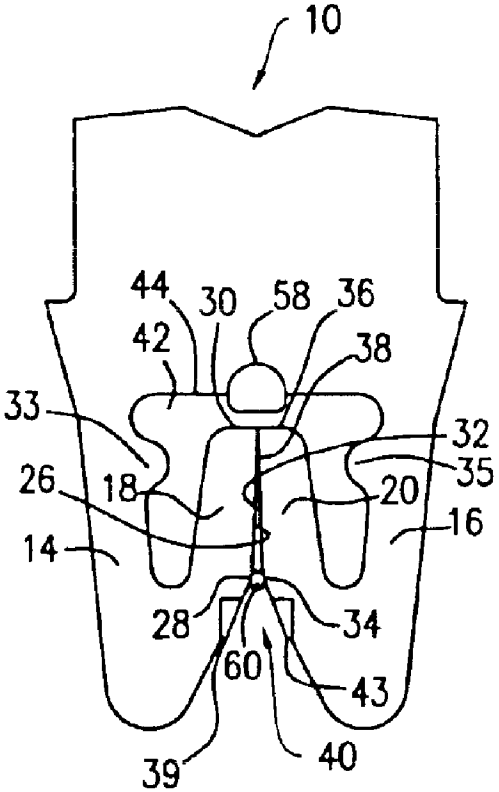
Figure 3A:
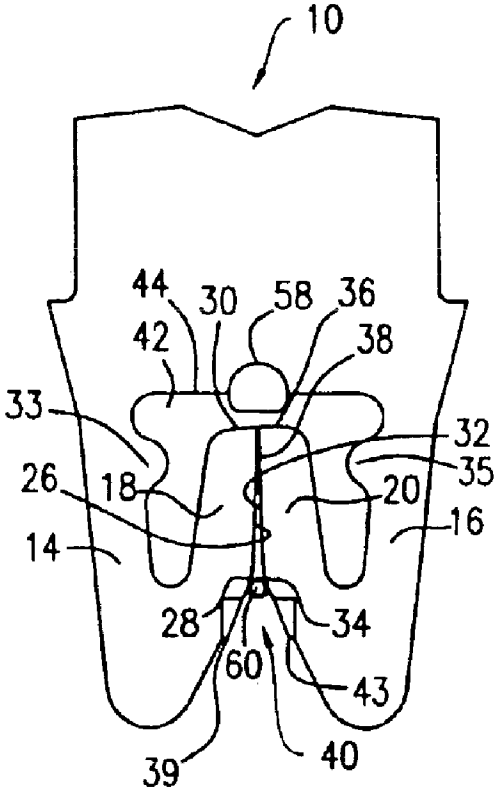

FIGS. 3*a* through 3*c* illustrate the sequence of the connector 10 engaging a small-sized wire 60. The wire 60 can be, for example, 34 AWG magnet wire, which is relatively small in diameter. In the first stage of the sequence, as shown by FIG. 3*a*, the wire 60 enters the entry gap 40 and makes initial contact with the connector 10 at the transition points 28, 34. It is noteworthy that the wire 60 (which is relatively small in diameter) does not make any contact with the cutters 39, 43. In the second stage of the sequence, as shown by FIG. 3*b*, the wire 60 enters the wire slot 38. As the wire 60 enters the wire slot 38, longitudinal (i.e., shearing) forces are exerted against the sides of the wire 60 by the transition points 28, 34. As a result, the transition points 28, 34 strip off the insulation from the wire 60. In the third and final stage of the sequence, as shown by FIG. 3*c*, the continued insertion of the wire 60 into the wire slot 38 continues to force the wire slot 38 open and cause the inner legs 18, 20 to spread apart from one another. It is noteworthy that the stops 33, 35 are not utilized when the connector 10 engages the wire 60 (which has a relatively small diameter). As the wire 60 travels through the wire slot 38, the inboard sides 26, 32 of the inner legs 18, 20 scrape the metal core of the wire 60 where the insulation of the wire 60 has been stripped off, thereby creating clean surfaces on the sides of the metal core of the wire 60. As a result, full material contact between the connector 10 and the wire 60 is achieved and, therefore, a good electrical connection between the connector 10 and the wire 60 is created. Moreover, when the wire 60 is fully engaged with the connector 10, the inner legs 18, 20 create a lateral clamping force on the wire 60. This lateral clamping force ensures that constant pressure is maintained on the wire 60 by the connector 10, thereby creating a gas-tight connection between the connector 10 and the wire 60. The barrier 58 prevents the wire 60 from traveling too far through the wire slot 38 and past the free ends 30, 36 of the inner legs 18, 20 and into the lateral branch 44 of the cutout 42.

It is noteworthy that when the wire 60 is fully engaged with the connector 10, the inner legs 18, 20 flex within their elastic limit in order to compensate for ordinary vibrations exerted on the connector 10, as well as diameter changes of the wire 60 that are caused by reduced or elevated temperatures. It is also noteworthy that the outer legs 14, 16 do not exert any force on the wire 60 when the wire 10 engages the connector 10. Accordingly, the forces that are required to strip the insulation of the wire 60 and to insert the wire 60 into the wire slot 38 are relatively small and, therefore, do not exceed the shear strength of the wire 60. As a result, severing of the wire 60 by the connector 10 is inhibited.

Figure 4D:
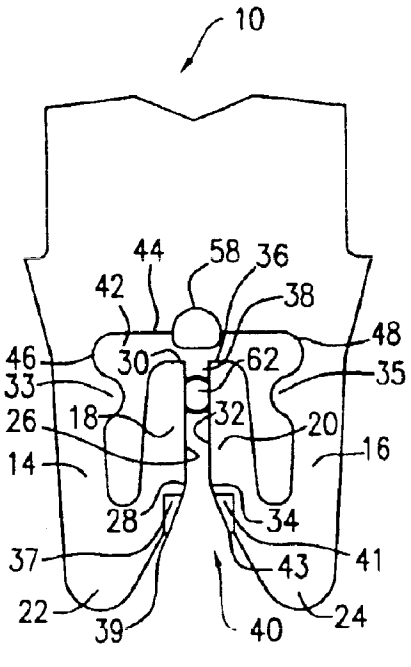
FIGS. 4*a–d* are sequential front elevational views showing the insulation stripping connector of FIGS. 1 and 2 as it is being connected to a medium size wire.
Figure 4C:
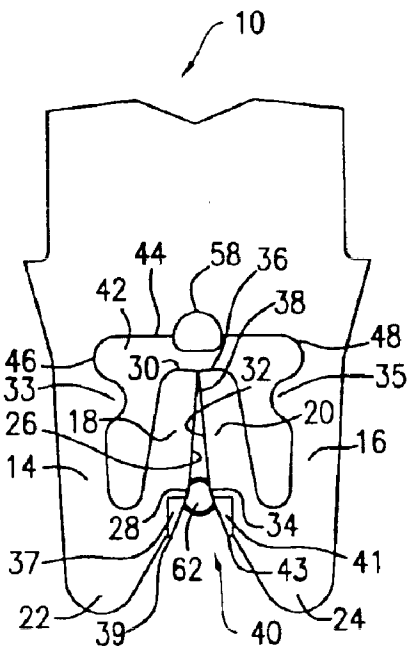
Figure 4B:
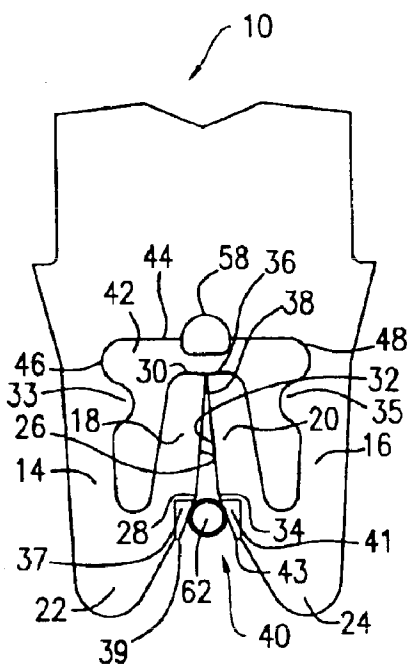
Figure 4A:
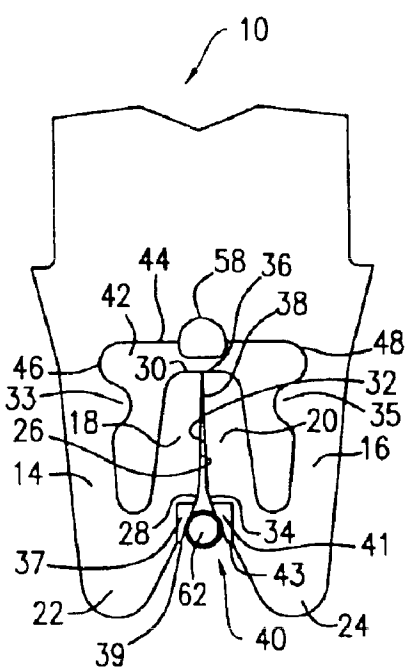

FIGS. 4*a* through 4*d* show the sequence of the connector 10 engaging a mid-sized wire 62. The wire 62 can be, for example, 26 AWG magnet wire, which has a relatively mid-size diameter. In the first stage of the sequence, as shown by FIG. 4*a*, the wire 62 enters the entry gap 40 and makes initial contact with the connector 10 against the common spans 22, 24 and below the transition points 28, 34. It is noteworthy that the wire 62 (which has a relatively mid-size diameter) does not make any contact with the cutters 39, 43. In the second stage of the sequence, as shown by FIG. 4*b*, lateral forces are exerted by the wire 62 at the common spans 22, 24 and, in turn, against the outer legs 14, 16. These lateral forces cause the outer leg 14 to flex at the notch 46 and the outer leg 16 to flex at the notch 48, thereby causing the outer legs 14, 16 to spread apart from one another. Since the inner leg 18 is connected to the outer leg 14 by the common span 22 and the inner leg 20 is connected to the outer leg 16 by the common span 24, the aforesaid lateral forces also cause the inner legs 18, 20 to spread apart from one another, which, in turn, causes the wire slot 38 to open to an appropriate size for the receipt of the wire 62.

In the third stage of the sequence, as shown by FIG. 4*c*, the wire 62 makes initial contact with the transition points 28, 34. At this point, the lateral forces that cause the outer legs 14, 16 to spread apart diminish, while longitudinal forces are exerted on the sides of the wire 62 by the transition points 28, 34. As a result, the transition points 28, 34 strip off the insulation from the wire 62. In the fourth and final stage of the sequence, as shown by FIG. 4*d*, the continued insertion of the wire 62 into the wire slot 38 continues to force the wire slot 38 open and cause the inner legs 18, 20 to spread apart from one another. It is noteworthy that the stops 33, 35 are not utilized when the connector 10 engages the wire 62 (which has a relatively mid-size diameter). As the wire 62 travels through the wire slot 38, the inboard sides 26, 32 of the inner legs 18, 20 scrape the metal core of the wire 62 where the insulation of the wire 62 has been stripped off, thereby creating clean surfaces on the sides of the metal core of the wire 62. As a result, full material contact between the connector 10 and the wire 62 is achieved and, therefore, a good electrical connection between the connector 10 and the wire 62 is created. Moreover, when the wire 62 is fully engaged with the connector 10, the inner legs 18, 20 create a lateral clamping force on the wire 62. This lateral clamping force ensures that constant pressure is maintained on the wire 62 by the connector 10, thereby creating a gas-tight connection between the connector 10 and the wire 62. The barrier 58 prevents the wire 62 from traveling too far through the wire slot 38 and past the free ends 30, 36 of the inner legs 18, 20 and into the lateral branch 44 of the cutout 42. It is noteworthy that when the wire 62 is fully engaged with the connector 10, the inner legs 18, 20 flex within their elastic limit in order to compensate for ordinary vibrations exerted on the connector 10, as well as diameter changes of the wire 62 that are caused by reduced or elevated temperatures.

Figure 5C:
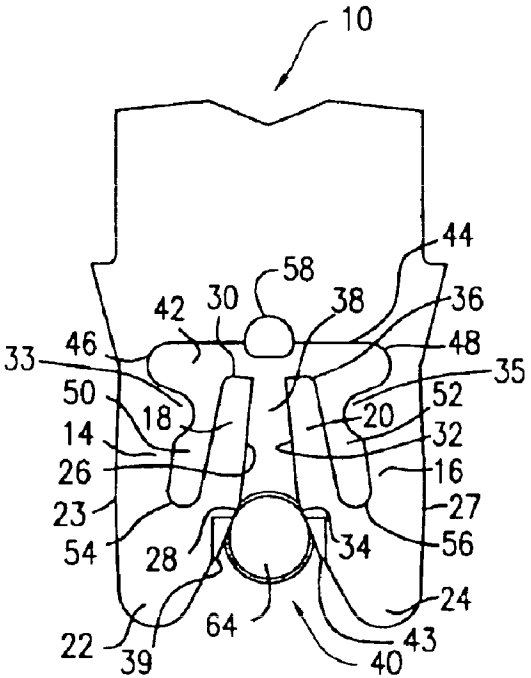
FIGS. 5*a–e* are sequential front elevational views showing the insulation stripping connector of FIGS. 1 and 2 as it is being connected to a large size wire.
Figure 5B:
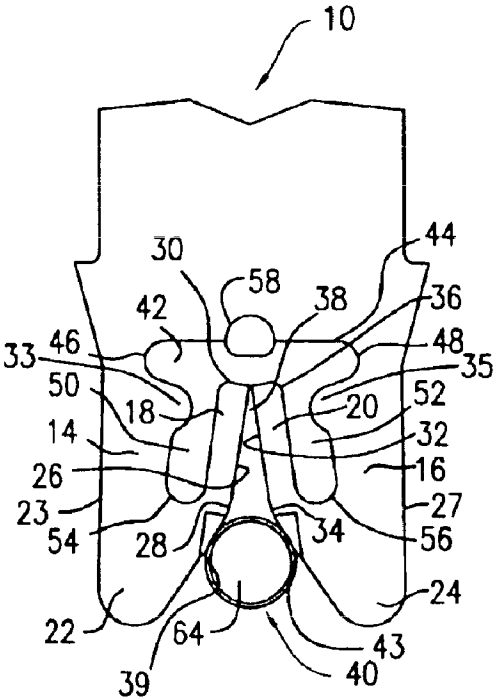
Figure 5A:
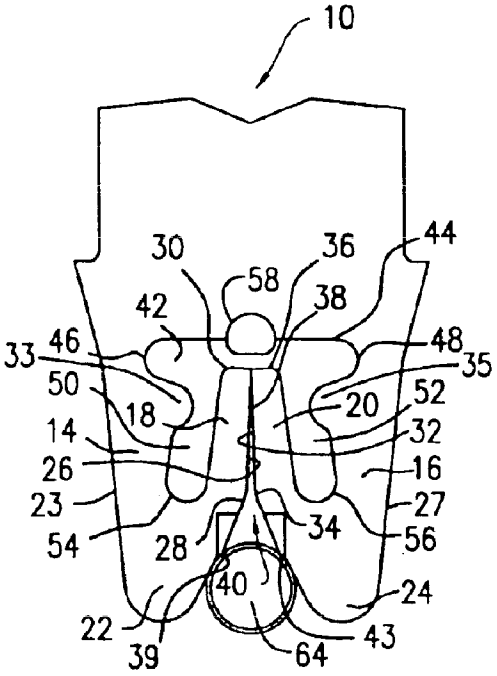

FIGS. 5*a* through 5*e* show the sequence of the connector 10 engaging a large-sized wire 64. The wire 64 can be, for example, 18 AWG magnet wire, which is relatively large in diameter. In the first stage of the sequence, as shown by FIG. 5*a*, the connector 10 enters the entry gap 40 and makes initial contact with the connector 10 against the common spans 22, 24 and below the transition points 28, 34. In the second stage of the sequence, as shown by FIG. 5*b*, lateral forces are exerted by the wire 62 at the common spans 22, 24 and, in turn, against the outer legs 14, 16. These lateral forces cause the outer leg 14 to flex at the notch 46 and the outer leg 16 to flex at the notch 48, thereby causing the outer legs 14, 16 to spread apart from one another. The outer legs 14, 16 are spread apart until the outboard sides 23, 27 thereof impact the sides of a housing or bobbin 66 in which the connector 10 is inserted (not shown in FIGS. 5*a* through 5*e*, but see FIGS. 6*a* and 6*b*). Since the inner leg 18 is connected to the outer leg 14 by the common span 22 and the inner leg 20 is connected to the outer leg 16 by the common span 24, the aforesaid lateral forces cause the inner legs 18, 20 to spread apart, which, in turn, causes the wire slot 38 to open to an appropriate size for the receipt of the wire 64.

Also during the second stage, the cutters 39, 43 slice the insulation from the wire 64 and create tears therein. This allows the transition points 28, 34 to more easily strip the insulation from the wire 64, which has a thick insulation due to its relatively large size.

Figure 5D:
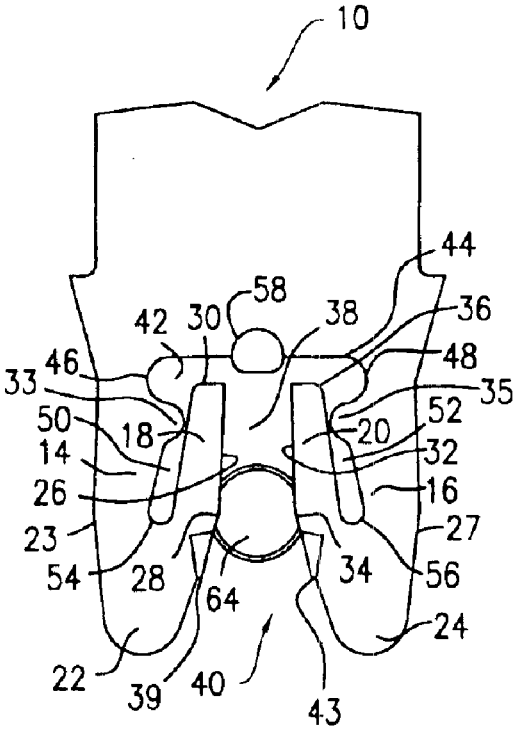

In the third stage of the sequence, as shown by FIG. 5*c*, the aforesaid lateral forces created by the wire 64 continue to be exerted on the outer legs 14, 16, while longitudinal forces are exerted against the wire 64 by the transition points 28, 34. Furthermore, the common span 22 rotates in a counterclockwise direction about the notch 54, while the common span 24 rotates in a clockwise direction about the notch 56. As a result, the longitudinal branches 50, 52 begin to collapse. In the fourth stage of the sequence, as shown by FIG. 5*d*, the wire 64 continues to engage the connector 10 at the transition points 28, 34. At this stage, the wire slot 38 continues to be forced open by the wire 64, thereby further spreading apart the inner legs 18, 20 and further collapsing the longitudinal branches 50, 52. Moreover, the aforesaid lateral forces acting against the outer legs 14, 16 diminish, while the longitudinal forces acting against the wire 64 at the transition points 28, 34 remain. As a result, the transition points 28, 34 strip off the insulation from the wire 64. Also during the fourth stage, the stop 33 restricts the rotational movement of the inner leg 18, while the stop 35 restricts the rotational movement of the inner leg 20 so as to prevent the inner legs 18, 20 from overstressing. As a result, each of the inner legs 18, 20 maintains its resiliency.

Figure 5E:
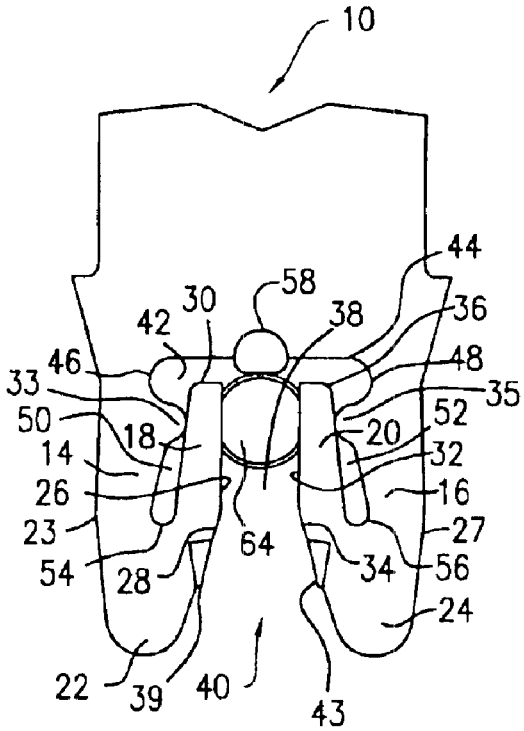

In the fifth and final stage of the sequence, as shown by FIG. 5*e*, the continued insertion of the wire 64 into the wire slot 38 continues to force open the wire slot 38, thereby spreading apart the inner legs 18, 20. As the wire 64 travels through the wire slot 38, the inboard sides 26, 32 of the inner legs 18, 20 scrape the metal core of the wire 64 where the insulation of the wire 64 has been stripped off, thereby creating clean surfaces on the sides of the metal core of the wire 64. As a result, full material contact between the connector 10 and the wire 64 is achieved and, therefore, a good electrical connection between the connector 10 and the wire 64 is created. Moreover, when the wire 64 is fully engaged with the connector 10, the inner legs 18, 20 create a lateral clamping force on the wire 64. This lateral clamping force ensures that constant pressure is maintained on the wire 64 by the connector 10, thereby creating a gas-tight connection between the connector 10 and the wire 64. It is noteworthy that when the wire 64 is fully engaged with the connector 10, the inner legs 18, 20 are preloaded in order to compensate for ordinary vibrations exerted on the connector 10, as well as diameter changes of the wire 64 caused by reduced or elevated temperatures. The barrier 58 prevents the wire 64 from traveling past the free ends 30, 36 of the inner legs 18, 20 and into the lateral branch 44 of the cutout 42 and past the tangential center-point of each of the stops 33, 35. As a result, the preloaded state of the inner legs 18, 20 is maintained, thereby ensuring a good electrical connection between the wire 64 and the connector 10.

Figure 6A:
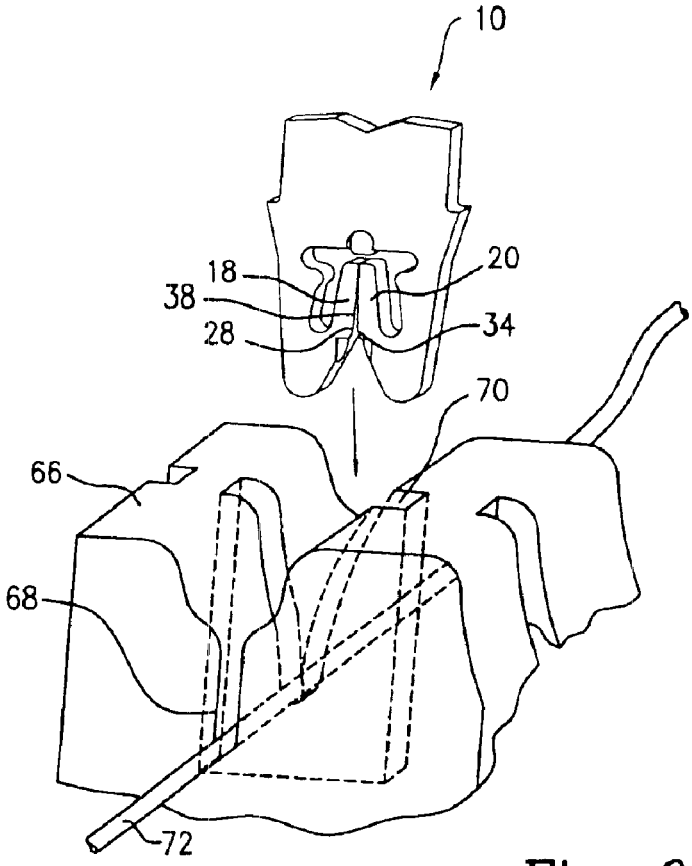
FIGS. 6*a* and 6*b* are sequential front perspective views showing the insulation stripping connector of FIGS. 1 and 2 as it is being inserted in an associated bobbin and over a wire.
Figure 6B:
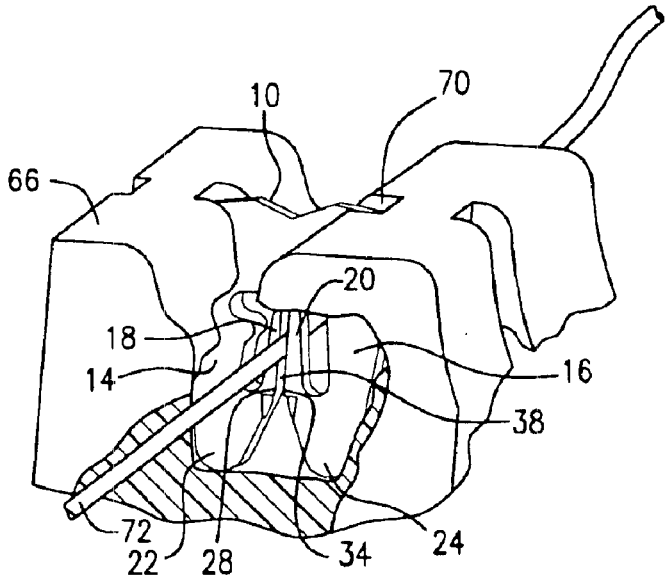

FIGS. 6*a* and 6*b* show the sequence of the connector 10 being inserted into its associated bobbin 66. Referring initially to FIG. 6*a*, the bobbin 66 includes a wire slot 68 that longitudinally traverses the bobbin 66 and a connector slot 70 that laterally traverses the bobbin 66 ninety (90) degrees from the wire slot 68. The wire slot 68 is shaped and sized to accommodate receipt of a wire 72, while the connector slot 70 is shaped and sized to accommodate receipt of the connector 10.

Referring now to FIG. 6*b*, the connector 10 is inserted into the connector slot 70, thereby forcing the wire 72 into the wire slot 38 of the connector 10. Depending upon the size of the wire 72, the connector 10 engages the wire 72 and otherwise functions in a manner as previously described herein and as shown by FIGS. 3*a* through 3*c* (for small-sized wire), FIGS. 4*a* through 4*d* (for mid-sized wire) and FIGS. 5*a* through 5*e* (for large-sized wire).

Specifically, the connector 10 has been adapted for use in connection with magnet wires. However, the connector 10 can be utilized with other types of wire.

Figure 7:
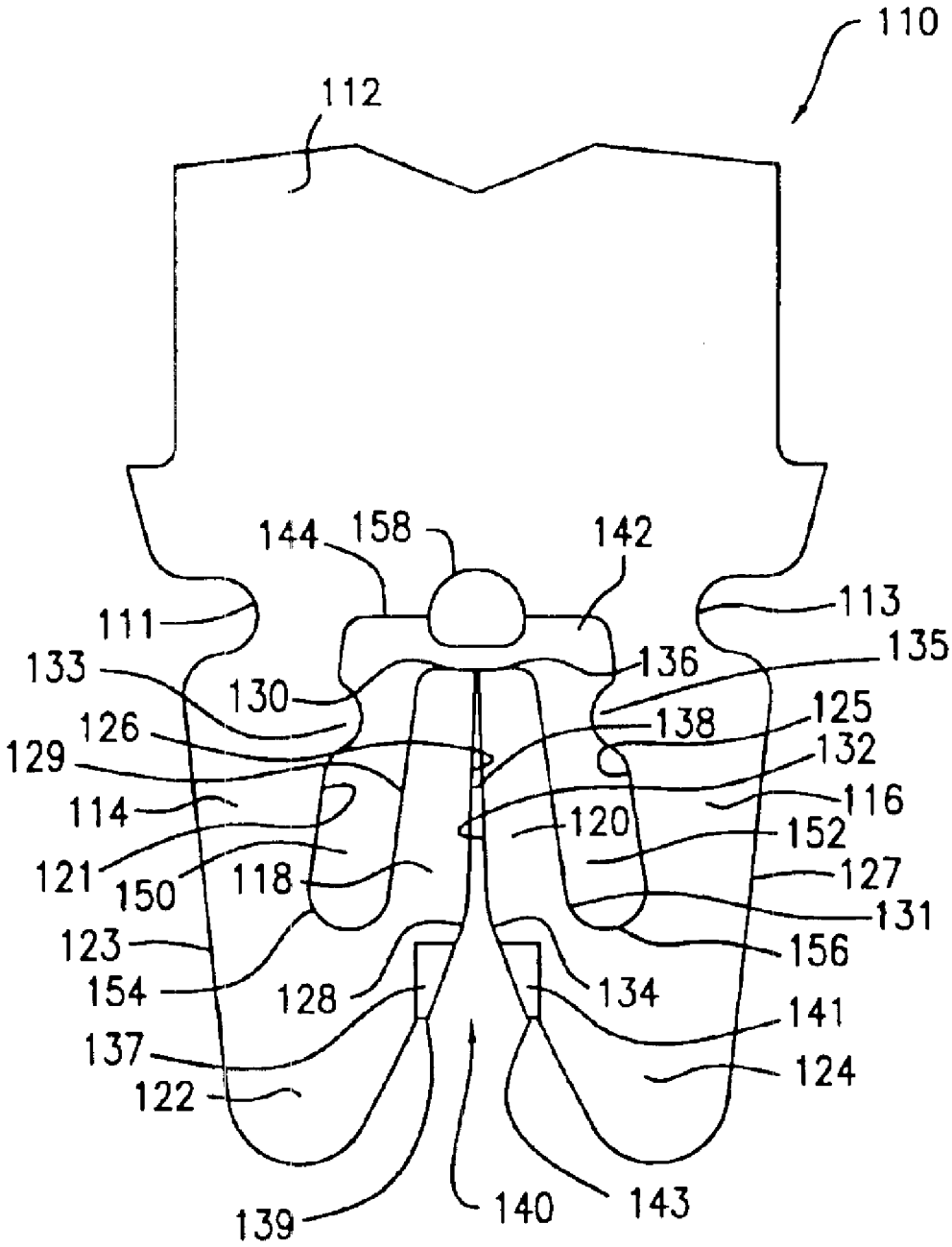
FIG. 7 is a front elevational view of an insulation stripping connector constructed in accordance with a second exemplary embodiment of the present invention.

Another exemplary embodiment of the present invention is illustrated in FIG. 7. Elements illustrated in FIG. 7 that correspond to the elements described above with reference to FIGS. 1 and 2 have been designated by corresponding reference numerals increased by one hundred (100). The embodiment of FIG. 7 operates in the same manner as the embodiment of FIGS. 1 and 2, unless it is otherwise stated.

Referring to FIG. 7, an insulation stripping connector 110 includes a body 112, a pair of cantilevered outer legs 114, 116 that extend from the body 112 in a longitudinal direction, and a pair of inner legs 118, 120 that extend in an opposite longitudinal direction. The outer leg 114 has an inboard side 121 and an outboard side 123 opposite the inboard side 121. Similarly, the outer leg 116 has an inboard side 125 and an outboard side 127 opposite the inboard side 125. The connector 110 further includes a notch 111 that is located on the outboard side 123 of the outer leg 114 and between the outer leg 114 and the body 112, and a notch 113 that is located on the outboard side 127 of the outer leg 116 and between the outer leg 116 and the body 112. The function of the notches 111, 113 will be described hereinafter.

Still referring to FIG. 7, the outer leg 114 is joined to the inner leg 118 by a common span 122, thereby forming a V-shape. Similarly, the outer leg 116 is joined to the inner leg 120 by a common span 124, thereby forming a V-shape. The outer legs 114, 116, the inner legs 118, 120 and the common spans 122, 124 cooperate to form a W-shape. The inner leg 118 includes an inboard side 126 that extends from a transition point 128 to a free end 130 of the inner leg 118 and an outboard side 129 opposite the inboard side 126. Similarly, the inner leg 120 includes an inboard side 132 that extends from a transition point 134 to a free end 136 of the inner leg 120 and an outboard side 131 opposite the inboard side 132. The inboard side 121 of the outer leg 114 has a semicircular-shaped stop 133 that extends toward the outboard side 129 of the inner leg 118. Similarly, the inboard side 125 of the outer leg 116 has a semicircular-shaped stop 135 that extends toward the outboard side 131 of the inner leg 120. The function of the stops 133, 135 shall be described hereinafter. The inboard sides 126, 132 of the inner legs 118, 120 form a narrow wire slot 138 whose function will be described hereinafter. The inner legs 118, 120 converge at their respective free ends 130, 136. It is noted that the free ends 130, 136 of the inner legs 118, 120 are resiliently biased, but they can be forced apart in a manner that will be described hereinafter. The transition points 128, 134 are located where the inboard sides 126, 132 of the inner legs 118, 120 are joined to the common spans 122, 124. An entry gap 140, whose function will be described hereinafter, is located between the common spans 122, 124.

The common span 122 contains a coined area 137 located below the transition point 128 and proximate to the entry gap 140, which forms a triangular shaped cutter 139 that extends into the entry gap 140. Similarly, the common span 124 contains a coined area 141 located below the transition point 134 and proximate to the entry gap 140, which forms a triangular shaped cutter 143 that extends into the entry gap 140. The function of the coined areas 137, 141 and the cutters 139, 143 shall be described hereinafter.

Still referring to FIG. 7, the connector 110 further includes a cutout 142 that separates the inner leg 118 from the body 112 and from the outer leg 114, while also separating the inner leg 120 from the body 112 and from the outer leg 116. More particularly, the cutout 142 includes a lateral branch 144 that separates the free end 130 of the inner leg 118 and the free end 136 of the inner leg 120 from the body 112. The cutout 142 further includes a pair of longitudinal branches 150, 152. The longitudinal branch 150 extends from the lateral branch 144 and separates the inboard side 121 of the outer leg 114 from the outboard side 129 of the inner leg 118. Similarly, the longitudinal branch 152 extends from the lateral branch 144 and separates the inboard side 125 of the outer leg 116 from the outboard side 131 of the inner leg 120. The longitudinal branch 150 terminates at an end remote from the lateral branch 144 in the form of a semicircular-shaped notch 154 whose function will be described hereinafter. Similarly, the longitudinal branch 152 terminates at an end remote from the lateral branch 144 in the form of a semicircular-shaped notch 156. A semicircular-shaped barrier 158 is coined from the body 112 and extends into the lateral branch 144. The barrier 158, which can have other shapes and sizes, is located directly above the free ends 130, 136 of the inner legs 118, 120 to perform a function that shall be described hereinafter.

It is noteworthy that the body 112 can consist of many different shapes and sizes, depending upon the specific application of the connector 110. While the notches 111, 113 and the notches 154, 156 are preferably semicircular in shape, it should be noted that they could consist of other shapes and sizes. Also, the stops 133, 135 are preferably semicircular in shape, but they can consist of other shapes and sizes. The cutters 139, 143 are preferably triangular in shape, but they can consist of other shapes and sizes. In addition, the connector 110 is preferably manufactured from copper alloy. However, the connector 110 may be made from other materials.

The embodiment of FIG. 7 operates in the same manner as the embodiment of FIGS. 1 and 2 with one difference. That is, when the connector 110 engages a mid-size wire or a large-size wire, the lateral forces exerted against the outer legs 114, 116 cause the outer leg 114 to flex at the notch 111 and the outer leg 116 to flex at the notch 113, thereby causing the outer legs 114, 116 to spread apart from one another.

Specifically, the connector 110 has been adapted for use in connection with magnet wires. However, the connector 110 can be utilized with other types of wire.

It should be understood that the embodiments described herein are merely exemplary and that a person skilled in the art may make many variations and modifications without departing from the spirit and scope of the invention. Accordingly, all such variations and modifications are intended to be included within the scope of the invention as defined in the appended claims.

What is claimed is:

1. An insulation stripping connector for providing an electrical connection to a wire, comprising a body; a pair of outer legs extending away from said body in a first direction, each of said outer legs having a first end attached to said body and a second end distal to said body; and a pair of inner legs extending toward said body in a second direction, which is generally opposite said first direction, to form a wire slot therebetween, each of said inner legs being joined to a corresponding one of said outer legs at said second end thereof, and each of said inner legs terminating at a free end which is spaced from said body and from said outer legs, each of said inner legs and each of said outer legs being sufficiently flexible in order to enable said wire slot to open in response to the insertion of a wire into said wire slot, at least one of said outer legs being notched in the vicinity of said first end thereof so as to form a region of reduced width at said first end of said at least one outer leg, said region of reduced width creating a pivot point for said at least one of said outer legs while increasing its flexibility, whereby said wire slot opens wider in order to accommodate a large range of wire sizes, wherein said free ends of said inner legs are movable between a first position, in which said free ends abut each other, and a second position, in which said free ends are spaced apart from each other; wherein said free ends of said inner legs move from said first position to said second position in response to insertion of a wire in said wire slot; wherein each of said outer legs has an inboard side proximate to said wire slot and an outboard side opposite said inboard side; wherein each of said inner legs has an inboard side proximate to said wire slot and an outboard side opposite said inboard side; wherein one of said outer legs has a first stop extending from said inboard side thereof toward said outboard side of an adjacent one of said inner legs, and the other of said outer legs has a second stop extending from said inboard side thereof toward said outboard side of the other of said inner legs, said first stop defining the limit of said second position of said adjacent one of said inner legs and said second stop defining the limit of said second position of said other of said inner legs; and wherein at least one of said stops is adjacent said region of reduce width.

2. The insulation stripping connector as claimed in claim 1, wherein each of said outer legs is notched in the vicinity of said first ends thereof, whereby the flexibility of both of said outer legs is increased.

3. The insulation stripping connector as claimed in claim 1, wherein one of said outer legs has a first notch formed in said inboard side thereof.

4. The insulation stripping connector as claimed in claim 3, wherein the other of said outer legs has a second notch formed in said inboard side thereof.

5. The insulation stripping connector as claimed in claim 1, wherein one of said outer legs has a first notch formed in said outboard side thereof.

6. The insulation stripping connector as claimed in claim 5, wherein the other of said outer legs has a second notch formed in said outboard side thereof.

7. The insulation stripping connector as claimed in claim 1, wherein said body, said inner legs and said outer legs form a cutout that separates each of said inner legs from said body and from its said corresponding one of said outer legs.

8. The insulation stripping connector as claimed in claim 7, wherein said cutout has a first branch that separates sold free ends of said inner legs from said body, and second and third branches that extend generally perpendicular from said first branch and terminate at ends distal from said first branch, said second branch separating one of said inner legs from its said corresponding one of said outer legs, and said third branch separating the other of said inner legs from its said corresponding one of said outer legs.

9. The insulation stripping connector as claimed in claim 8, wherein said first branch terminates at one end in the form of a first notch formed in said inboard side of one of said outer legs and at another end in the form of a second notch formed in said inboard side of the other of said outer legs, whereby the flexibility of both of said outer legs is increased.

10. The insulation stripping connector as claimed in claim 9, wherein said ends of said second and third branches are notched, whereby the flexibility of both of said inner legs is increased.

11. The insulation stripping connector as claimed in claim 1, further comprising barrier means, extending from said body towards said free ends of said inner legs, for inhibiting a wire from passing completely through said wire slot.

12. The insulation stripping connector as claimed in claim 11, wherein said barrier means includes a coined area, located a predetermined distance from said free ends of said inner legs, for inhibiting a wire from passing beyond said free ends of said inner legs and losing full contact with said inner legs.

13. The insulation stripping connector as claimed in claim 1, wherein each of said inner legs has an opposite end distal from said free end thereof, each of said inner legs pivoting about said opposite end thereof relative to its said corresponding one of said outer legs.

14. The insulation stripping connector as claimed in claim 13, wherein each of said inner legs pivots toward and away from said wire slot.

15. The insulation stripping connector as claimed in claim 1, wherein each of said outer legs pivots about said first end thereof relative to said body.

16. The insulation stripping connector as claimed in claim 15, wherein each of said outer legs pivots toward and away from said wire slot.

17. The insulation stripping connector as claimed in claim 1, wherein said free ends of said inner legs are resiliently biased toward said first position.

18. The insulation stripping connector as claimed in claim 1, wherein one of said pair of inner legs is joined to one of said pair of outer legs at a first common span, and the other of said pair of inner legs is joined to the other of said pair of outer legs at a second common span.

19. The insulation stripping connector as claimed in claim 18, wherein said one inner leg, said one outer leg and said first common span cooperate to form a V-shape; and wherein said other inner leg, said other outer leg and said second common span cooperate to form a V-shape.

20. The insulation stripping connector as claimed in claim 18, wherein said pair of inner legs, said pair of outer legs and said first and second common spans cooperate to form a W-shape.

21. The insulation stripping connector as claimed in claim 18, wherein said first and second common spans are sized and shaped to form an entry gap located therebetween, said entry gap being sized and shaped to receive a wire during an insertion procedure.

22. The insulation stripping connector as claimed in claim 21, wherein said first common span has a first coined area located proximate to said entry gap, and said second common span has a second wined area located proximate to said entry gap, said first and second coined areas cooperating with each other to strip off insulation from a wire which is being inserted in said wire slot.

23. The insulation stripping connector as claimed in claim 22, wherein said first coined area has a first cutter for stripping off insulation from a wire and said second coined area has a second cutter for stripping off insulation from a wire.

24. The insulation stripping connector as claimed in claim 1, wherein each of said inner legs has a transition point located on said inboard side at an end distal from said free end thereof, said transition point of one of said inner legs cooperating with said transition point of the other of said inner legs to strip off insulation from a wire which is being inserted in said wire slot.

25. In combination, a housing having a connector slot; and an insulation stripping connector removably received within said connector slot of said housing, said connector including a body, a pair of outer legs extending away from said body in a first direction, each of said outer legs having a first end attached to said body and a second end distal to said body, and a pair of inner legs extending toward said body in a second direction, which is generally opposite said first direction, to form a wire slot therebetween, each of said inner legs being joined to a corresponding one of said outer legs at said second end thereof, and each of said inner legs terminating at a free end which is spaced from said body and from said outer legs, each of said inner legs and each of said outer legs being sufficiently flexible in order to enable said wire slot to open in response to the insertion of a wire into said wire slot, at least one of said outer legs being notched in the vicinity of said first end thereof so as to form a region of reduced width at said first end of said at least one outer leg, said region of reduced width creating a pivot point for said at least one of said outer legs while increasing its flexibility, whereby said wire slot opens wider in order to accommodate a large range of wire sizes, wherein said free ends of said inner legs are movable between a first position, in which said free ends abut each other, and a second position, in which said free ends are spaced apart from each other; wherein said free ends of said inner legs move from said first position to said second position in response to insertion of a wire in said wire slot; wherein each of said outer legs has an inboard side proximate to said wire slot and an outboard side opposite said inboard side; wherein each of said inner legs has an inboard side proximate to said wire slot and an outboard side opposite said inboard side; wherein one of said outer legs has a first stop extending from said inboard side thereof toward said outboard side of an adjacent one of said inner legs, and the other of said outer legs has a second stop extending from said inboard side thereof toward said outboard side of the other of said inner legs, said first stop defining the limit of said second position of said adjacent one of said inner legs and said second stop defining the limit of said second position of said other of said inner legs; and wherein at least one of said stops is adjacent said region of reduce width.

26. The combination as claimed in claim 25, wherein each of said outer legs is notched in the vicinity of said first ends thereof, whereby the flexibility of both of said outer legs is increased.

27. The combination as claimed in claim 25, wherein one of said outer legs has a first notch formed in said inboard side thereof.

28. The combination as claimed in claim 27, wherein the other of said outer legs has a second notch formed in said inboard side thereof.

29. The combination as claimed in claim 25, wherein one of said outer legs has a first notch formed in said outboard side thereof.

30. The combination as claimed in claim 29, wherein the other of said outer legs has a second notch formed in said outboard side thereof.

31. The combination as claimed in claim 25, wherein said body, said inner legs and said outer legs form a cutout that separates each of said inner legs from said body and from its said corresponding one of said outer legs.

32. The combination as claimed in claim 31, wherein said cutout has a first branch that separates said free ends of said inner legs from said body, and second and third branches that extend generally perpendicular from said first branch and terminate at ends distal from said first branch, said second branch separating one of said inner legs from its said corresponding one of said outer legs, and said third branch separating the other of said inner legs from its said corresponding one of said outer legs.

33. The combination as claimed in claim 32, wherein said first branch terminates at one end in the form of a first notch formed in said inboard side of one of said outer legs and at another end in the form of a second notch formed in said inboard side of the other of said outer legs, whereby the flexibility of both of said outer legs is increased.

34. The combination as claimed in claim 33, wherein said ends of said second and third branches are notched, whereby the flexibility of both of said inner legs is increased.

35. The combination as claimed in claim 25, further comprising barrier means, extending from said body towards said tree ends of said inner legs, for inhibiting a wire from passing completely through said wire slot.

36. The combination as claimed in claim 35, wherein said bawler means includes a coined area, located a predetermined distance from said free ends of said inner legs, for inhibiting a wire from passing beyond said free ends of said inner legs and losing full contact with said inner legs.

37. The combination as claimed in claim 25, wherein each of said inner legs has an opposite end distal from said free end thereof, each of said inner legs pivoting about said opposite end thereof relative to its said corresponding one of said outer legs.

38. The combination as claimed in claim 37, wherein each of said inner legs pivots toward and away from said wire slot.

39. The combination as claimed in claim 25, wherein each of said outer legs pivots about said first end thereof relative to said body.

40. The combination as claimed in claim 39, wherein each of said outer legs pivots toward and away from said wire slot.

41. The combination as claimed in claim 25, wherein said free ends of said inner legs are resiliently biased toward said first position.

42. The combination as claimed in claim 25, wherein one of said pair of inner legs is joined to one of said pair of outer legs at a first common span, and the other of said pair of inner legs is lamed to the other of said pair of outer legs at a second common span.

43. The combination as claimed in claim 42, wherein said one inner leg, said one outer leg and said first common span cooperate to form a V-shape; and wherein said other inner leg, said other outer leg and said second common span cooperate to form a V-shape.

44. The combination as claimed in claim 42, wherein said pair of inner legs, said pair of outer legs and said first and second common spans cooperate to form a W-shape.

45. The combination as claimed in claim 42, wherein said first and second common spans are sized and shaped to farm an entry gap located therebetween, said entry gap being sized and shaped to receive a wire during an insertion procedure.

46. The combination as claimed in claim 45, wherein said first common span has a first coined area located proximate to said entry gap, and said second common span has a second coined area located proximate to said entry gap, said first and second coined areas cooperating with each other to strip off insulation from a wire which is being inserted in said wire slot.

47. The combination as claimed in claim 46, wherein said first coined area has a first cutter for stripping off insulation from a wire and said second coined area has a second cutter for stripping off insulation from a wire.

48. The combination as claimed in claim 25, wherein each of said inner legs has a transition point located on said inboard side at an end distal from said free end thereof, said transition point of one of said inner legs cooperating with said transition point of the other of said inner legs to strip off insulation from a wire which is being inserted in said wire slot.

* * * * *

UNITED STATES PATENT AND TRADEMARK OFFICE

CERTIFICATE OF CORRECTION

PATENT NO. : 6,908,331 B2
APPLICATION NO. : 10/669182
DATED : June 21, 2005
INVENTOR(S) : Donald C. Brown It is certified that error appears in the above-identified patent and that said Letters Patent is hereby corrected as shown below:

In the Claims:

Column 10, line 43, replace “sold” with --said--

Column 13, line 9, replace “bawler” with --barrier-- line 33, replace “lamed” with --joined--

Column 14, line 11, replace “farm” with --form--

Signed and Sealed this

Twenty-ninth Day of December, 2009

David J. Kappos

David J. Kappos
*Director of the United States Patent and Trademark Office*